United States Patent [19]

Nogimura

[11] 4,176,574

[45] Dec. 4, 1979

[54] FREQUENCY DIVIDER FOR TONE SOURCE APPARATUS FOR ARABIAN SCALE IN ELECTRONIC ORGAN

[75] Inventor: Tsunehisa Nogimura, Okegawa, Japan

[73] Assignee: Kabushiki Kaisha Kawai Gakki Seisakusho, Hamamatsu, Japan

[21] Appl. No.: 951,605

[22] Filed: Oct. 13, 1978

[51] Int. Cl.[2] ..... G10H 5/06

[52] U.S. Cl. ..... 84/1.01; 84/DIG. 11; 84/DIG. 23

[58] Field of Search ..... 84/1.01, 1.03, DIG. 11, 84/DIG. 23, 445; 307/243, 225 R, 220 R

[56] References Cited

U.S. PATENT DOCUMENTS

| | | | |
|---|---|---|---|
| 3,023,659 | 3/1962 | Bode | 84/445 |
| 3,401,229 | 9/1968 | Kawabata et al. | 84/1.04 |
| 3,808,344 | 4/1974 | Ippolito et al. | 84/1.01 |
| 3,809,787 | 5/1974 | Mochida | 84/1.01 |
| 3,816,635 | 6/1974 | Uetrecht | 84/1.01 |
| 3,871,261 | 3/1975 | Wells et al. | 84/1.01 |
| 3,902,125 | 8/1975 | Oliva | 307/220 R |
| 3,939,751 | 2/1976 | Harasek | 84/1.01 |
| 3,977,290 | 8/1976 | Sakashita | 84/1.01 |
| 4,009,633 | 3/1977 | Coles | 84/1.01 |
| 4,056,995 | 11/1977 | Uetrecht | 84/1.01 |

OTHER PUBLICATIONS

Simonton, J., "Portable Mini Organ", Radio-Electronics, Jan. 1977, p. 32.

*Primary Examiner*—Gene Z. Rubinson
*Assistant Examiner*—Forester W. Isen
*Attorney, Agent, or Firm*—Haseltine, Lake & Waters

[57] ABSTRACT

A frequency divider for a tone source for an Arabian scale in an electronic organ of the type wherein musical tone signals for a standard musical scale, musical tone signals higher than the same by 50 cents and musical tone signals lower than the same by 50 cents can be obtained from the output signal of a main oscillator. The output signal of the main oscillator is frequency-divided by at least one frequency divider to obtain an output signal. The aforesaid frequency divider comprises a counter and an AND circuit. An input terminal of the frequency divider is connected through the counter to an input terminal on one side of the AND circuit and is connected directly to an input terminal on the other side of the AND circuit.

4 Claims, 4 Drawing Figures

FREQUENCY DIVIDER FOR TONE SOURCE APPARATUS FOR ARABIAN SCALE IN ELECTRONIC ORGAN

FIELD OF INVENTION

This invention relates to a frequency divider for a tone source apparatus for an Arabian scale in an electronic organ.

BACKGROUND

The applicant has previously proposed an electronic organ wherein musical tone signals of a number covering at least one octave for obtaining musical scale tones of 100 in intervals equal to those in a standard organ, musical tone signals for obtaining scale tones which are lower, by 50 cents in intervals, than the foregoing scale tones, and musical tone signals for obtaining scale tones which are higher by 50 cents in intervals, than the foregoing scale tones are arranged to be selectively generated. They are selectively generated by the respective and selective operation of a plurality of selection switches so that Arabian scale tones can be obtained by respective and selective operation o a plurality of keyswitches from the musical tone signals selected by the operation of the foregoing selection switches (see Japanese Patent Applications Sho 51-103210 and Sho 51-102211, corresponding to U.S. Pat. application Ser. No. 827,619).

As for a tone source for the above apparatus, first, second and third scale dividers and a main oscillator are provided. The main oscillator is arranged to oscillate at a frequency of 2.179 MHz which is higher, by 50 cents, than an oscillation frequency for standard scale tones. An output terminal thereof is connected to the first scale divider and is also connected through a frequency divider to the second scale divider. Further, an output terminal of the frequency divider is connected through an additional frequency divider to the third scale divider. The frequency dividing ratio of each of the frequency dividers is 256/249.

As will be shown hereinafter, there may be a modified example, wherein the third scale divider and the frequency divider for the same are omitted. The musical tone signals which are higher by 50 cents than the musical tone signals for the standard tone scale tones are equal to those obtained in such a manner that the musical tone signals which are lower by 50 cents are moved by 100 cents towards the higher side, so that those can be omitted.

There is also another tone source wherein the frequency dividers are connected in series to an output terminal of a main oscillator, and their output terminals are connected to an OR circuit through corresponding input terminals on one side of respective AND circuits and an output terminal thereof is connected to a scale divider. Thus, by inputting signals selectively to input terminals on the other side of the respective AND circuits, musical tone signals corresponding to selected signals are obtained at respective output terminals of the scale divider.

It has been heretofore conventional with the above tone source apparatus that the frequency divider used therein is constructed by using two or three binary rate multipliers. This has involved such a disadvantage that the same is high in price.

SUMMARY OF THE INVENTION

This invention has for its object to provide a frequency divider free from the disadvantages of the prior art.

Another object of the invention is to provide an improved frequency divider and an improved tone source.

To achieve the above and other objects of the invention there is provided an improved frequency divider which comprises a counter, an AND circuit including two input terminals and an output terminal, and an input terminal connected through the counter to one of said terminals of the AND circuit and connected directly to the other input terminal of the AND circuit.

In further accordance with the invention, there is provided a tone source for an Arabian scale comprising two frequency dividers of the above-noted type, an oscillator, a scale divider coupled to said oscillator and two further scale dividers coupled respectively to said frequency dividers, said frequency dividers being coupled in series to said oscillator.

In accordance with another aspect of the invention, there is provided a tone circuit comprising a frequency divider of the above-noted type, an oscillator, a scale divider coupled to said oscillator and a further scale divider coupled to said frequency divider, said frequency divider being coupled to said oscillator.

In accordance with still another aspect of the invention, there is provided a tone source for an Arabian scale comprising two frequency dividers, an oscillator, said frequency divider being coupled in series with said oscillator, a plurality of AND gates coupled respectively to said oscillator and said frequency dividers and including respective actuating input terminals, an OR gate coupled to said AND gates, and a scale divider coupled to said AND gates by said OR gate to generate tone signals from signals received from said AND gate.

The above and other objects, features and advantages of the invention will be found in the detailed description which follows hereinafter as illustrated in the accompanying drawing.

DETAILED DESCRIPTION

Figure 1:
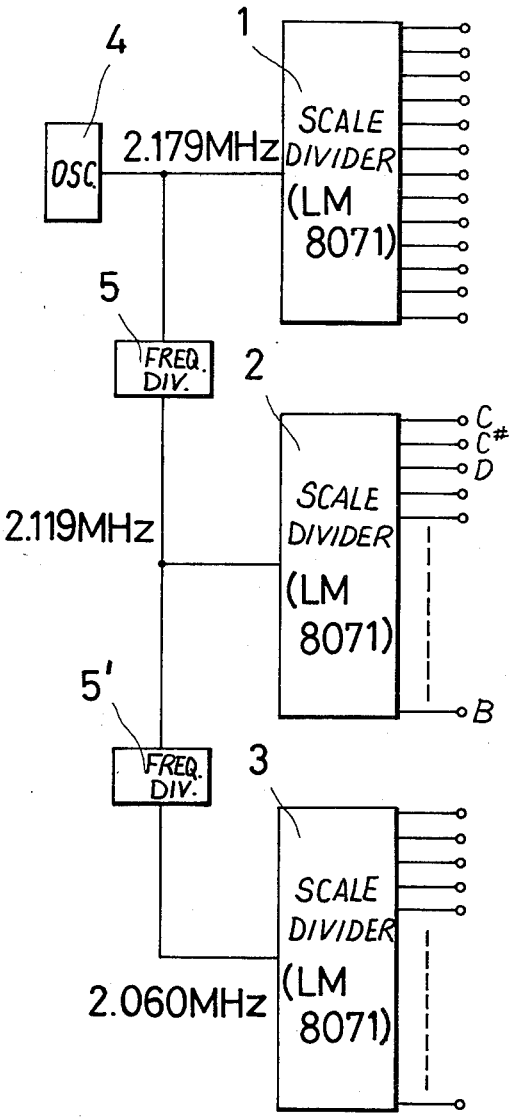
FIG. 1 is a block diagram of a tone source provided, generally, according to the prior art but improved by including a frequency divider in accordance with the instant invention.

For an improved tone source apparatus generally consistent with the prior art described hereinabove, there is, for instance, a tone source as shown in FIG. 1. Therein, three scale dividers 1, 2 and 3 and a main oscillator 4 are provided. The main oscillator 4 is arranged to oscillate at a frequency of 2.179 MHz which is higher, by 50 cents, thn an oscillation frequency for standard scale tones. An output terminal thereof is connected to the first scale divider 1 and is also connected through a frequency divider 5 to the second scale divider 2. Further, an output terminal of the frequency divider 5 is connected through an additional frequency divider 5' to the third scale divider 3. The frequency dividing ratio of each of the frequency dividers 5 and 5' is 256/249.

The frequencies of the signals obtained at the respective output terminals of the scale dividers 1, 2 and 3 are as shown in the following Table 1.

TABLE 1

| First Scale Divider Substantial Up | | Second Scale Divider Errors Cents | | Third Scale Divider Substantial Down | |
|---|---|---|---|---|---|
| (Hz) | Cents → ↓ | (Hz) | ↓ | (Hz) | Cents → ↓ |
| 1076.6 | +49 | 1047.1 | +1 | 1018.5 | −47 |
| 1139.6 | +48 | 1108.5 | 0 | 1078.2 | −48 |
| 1207.9 | +48 | 1174.8 | 0 | 1142.7 | −48 |
| 1278.8 | +47 | 1243.8 | −1 | 1209.8 | −49 |
| 1355.1 | +47 | 1318.0 | −1 | 1282.0 | −49 |
| 1437.3 | +49 | 1398.0 | +1 | 1359.8 | −47 |
| 1521.6 | +48 | 1480.0 | 0 | 1439.6 | −48 |
| 1611.7 | +48 | 1567.6 | 0 | 1524.8 | −48 |
| 1707.7 | +48 | 1661.0 | 0 | 1615.5 | −48 |
| 1809.8 | +48 | 1760.3 | 0 | 1712.2 | −48 |
| 1918.1 | +49 | 1865.7 | +1 | 1814.7 | −47 |
| 2032.6 | +49 | 1977.1 | +1 | 1923.0 | −46 |

Figure 2:
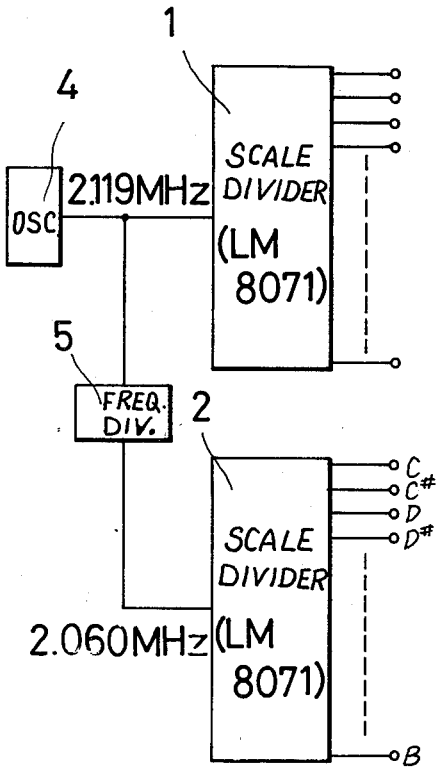
FIG. 2 is a block diagram of another tone source provided, generally, in accordance with the prior art but improved by including the frequency divider of the present invention.

FIG. 2 shows a modified example wherein the third scale divider 3 and the frequency divider 5' for the same are omitted. As will be clear from the above Table 1, the musical tone signals which are higher by 50 cents than the musical tone signals for the standard tone scale tones are equal to those obtained in such a manner that the musical tone signals which are lower by 50 cents are moved by 100 cents towards the higher side, so that those can be omitted.

Figure 3:
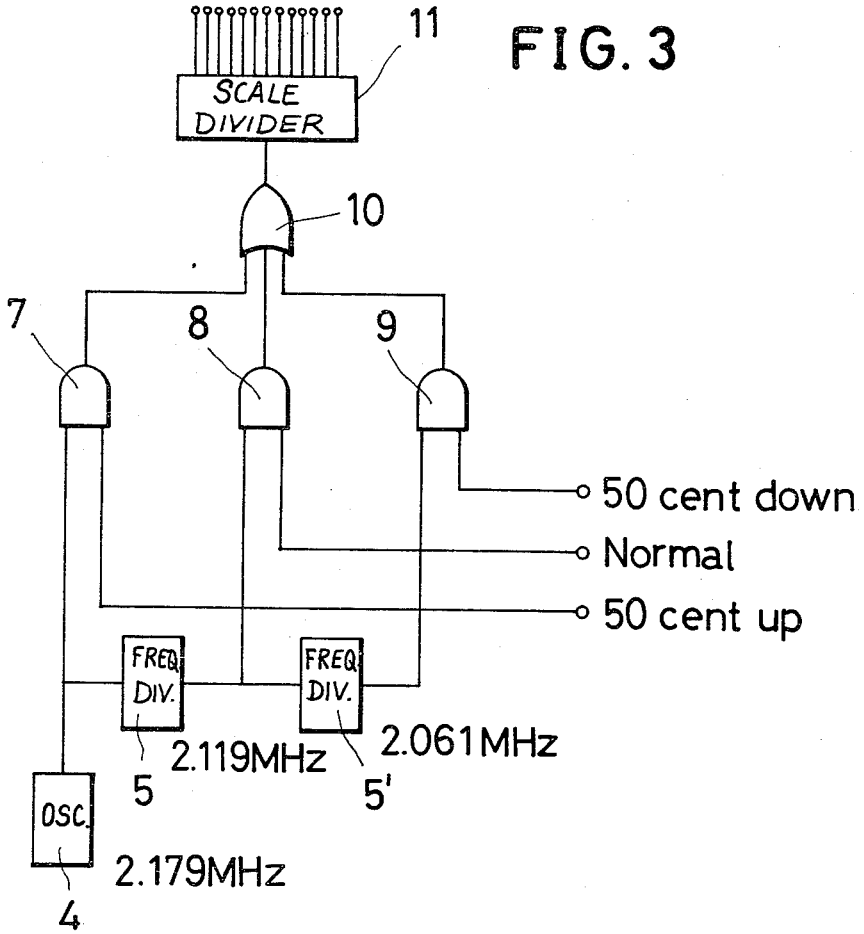
FIG. 3 is a tone source provided, generally, in accordance with the prior art but improved by including frequency divider circuits of the instant invention.

FIG. 3 shows another tone source wherein the frequency dividers 5 and 5' are connected in series to an output terminal of the main oscillator 4. Their output terminals are connected to an OR circuit 10 through corresponding input terminals on one side of respective AND circuits 7, 8 and 9. An output terminal thereof is connected to a scale divider 11 so that by inputting signals selectively to input terminals on the other side of the respective AND circuits 7, 8 and 9, musical tone signals corresponding to the selected signals as shown in the Table 1 are obtained at respective output terminals of the scale divider 11.

As noted hereinabove, it has been usual hitherto with the above tone sources that the frequency divider used therein is constructed by using two or three binary rate multipliers. This has involved the disadvantage that the apparatus is high in price.

This invention has as an object the provision of a frequency divider free from the above disadvantage. Such a frequency divider will next be explained with reference to FIG. 4.

Figure 4:
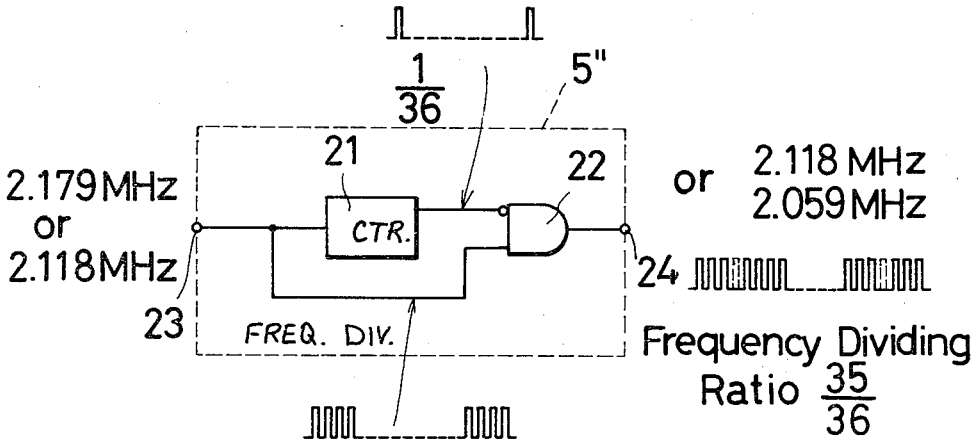
FIG. 4 is a logical diagram of a frequency divider provided in accordance with the invention.

In FIG. 4, the frequency divider 5'' comprises a counter 21 and an AND circuit 22. An input terminal 23 of the frequency divider 5 is connected through the counter 21 to an input terminal on one side of the AND circuit 22 and is connected directly to an input terminal on the other side of the AND circuit 22.

The counter 21 is a hexatridecimal (36) type counter comprising 6 flip-flop circuits (not shown). If a signal of 2.179 MHz is inputted to the input terminal 23, a signal of $2.179 \times 1/36$ MHz is outputted from the output terminal of the counter 21 and this signal is inputted to the input terminal on one side of the AND circuit 22. In the meanwhile, the signal of 2.179 MHz is directly applied to the input terminal on the other side of gate 22. Consequently, a signal of $2.179 \times 35/36 = 2.118$ MHz, with one pulse having been taken away from 36 input pulses inputted to the input terminal 23, is outputted from the output terminal 24 of the AND circuit 22. If, thereafter, a signal of 2.118 MHz is inputted, a signal of $2.118 \times 35/36 = 2.059$ MHz is outputted in almost the same manner as above. These frequency-divided frequencies are nearly equal to those shown in FIGS. 1 to 3. Thus, instead of the frequency dividers of the circuits shown in FIGS. 1 to 3, the frequency divider of FIG. 4 is used in accordance with the present invention.

The frequencies of the output signals of the scale dividers 1, 2 and 3 in a typical example wherein the foregoing divider is applied to FIG. 1 are as shown in the following Table 2.

TABLE 2

| First Scale Divider Substantial Up | | Second Scale Divider Error Cents | | Third Scale Divider Substantial Down | |
|---|---|---|---|---|---|
| (Hz) | Cents → ↓ | (Hz) | ↓ | (Hz) | Cents → ↓ |
| 1076.6 | +49 | 1046.4 | 0 | 1017.3 | −49 |
| 1139.6 | +48 | 1107.7 | −2 | 1076.9 | −50 |
| 1207.9 | +48 | 1174.1 | −1 | 1141.4 | −50 |
| 1278.8 | +47 | 1243.0 | −2 | 1208.3 | −51 |
| 1355.1 | +47 | 1317.2 | −2 | 1280.5 | −51 |
| 1437.3 | +49 | 1397.1 | 0 | 1358.2 | −49 |
| 1521.6 | +48 | 1479.1 | −1 | 1437.8 | −50 |
| 1611.7 | +48 | 1566.6 | −2 | 1522.9 | −51 |
| 1707.7 | +48 | 1659.9 | −1 | 1613.6 | −50 |
| 1809.8 | +48 | 1759.1 | −1 | 1710.1 | −50 |
| 1918.1 | +49 | 1864.4 | 0 | 1812.5 | −49 |
| 2032.6 | +49 | 1975.7 | 0 | 1920.7 | −49 |

Thus, according to this invention, the frequency divider 5'' is provided for a tone source apparatus for obtaining musical tone signals for the standard scale, musical tone signals which are lower by 50 cents than the same and musical tone signals which are higher 50 cents than the same. The frequency divider is so constructed that the counter 21 and the AND circuit 22 are employed. The output terminal of the counter 21 is connected to the input terminal on one side of the AND circuit 22, and the input terminal of the counter 21 is connected to the input terminal on the other side of the AND circuit 22. Thus, the frequency divider is simplified in construction and can be produced at a relatively low cost.

The invention is not limited to the specifically disclosed embodiments nor to the specific means shown, but it in contrast embraces all variations and modifications falling within the spirit and scope of the appended claims.

What is claimed is:

1. A tone source for an Arabian scale comprising a frequency divider including a counter, an AND circuit including two input terminals and an output terminal, and an input terminal connected through the counter to one of said input terminals of the AND circuit and connected directly to the other input terminal of the AND circuit, said counter being a 36 counter such that for every thirty-six input pulses to said counter thirty-five output pulses are produced to obtain musical tone signals at said output terminal which are lower in frequency by 50 cents.

2. A tone source as claimed in claim 1, further comprising an oscillator, a scale divider coupled to said oscillator, and two further scale dividers each coupled to a respective one said frequency divider, the frequency dividers being coupled in series to said oscillator whereby each frequency divider successively lowers the input frequency by 50 cents.

3. A tone source as claimed in claim 1, further comprising an oscillator, a scale divider coupled to said oscillator, and a further scale divider coupled to said frequency divider, said frequency divider being coupled to said oscillator to lower the output frequency thereof by 50 cents.

4. A tone source as claimed in claim 1, further comprising an oscillator, two said frequency dividers being coupled in series to said oscillator to successively lower the output frequency of the oscillator by 50 cents, a plurality of AND gates coupled respectively to said oscillator and said frequency dividers and including respective actuating input terminals, an OR gate coupled to said AND gates, and a scale divider coupled to said AND gates by said OR gate to generate tone signals from signals received from said AND gates whereby three output signals can be selectively fed from said OR gate, one being a nominal frequency and the other two being respectively higher and lower in frequency by 50 cents.

* * * * *